US006659451B2

(12) United States Patent
Kim

(10) Patent No.: US 6,659,451 B2
(45) Date of Patent: Dec. 9, 2003

(54) PAPER CASSETTE FOR AN IMAGE FORMING DEVICE

(75) Inventor: Kyung-Hwan Kim, Yongin (KR)

(73) Assignee: Samsung Electronics Co., Ltd., Suwon (KR)

( * ) Notice: Subject to any disclaimer, the term of this patent is extended or adjusted under 35 U.S.C. 154(b) by 40 days.

(21) Appl. No.: 09/880,941

(22) Filed: Jun. 15, 2001

(65) Prior Publication Data

US 2002/0084576 A1 Jul. 4, 2002

(30) Foreign Application Priority Data

Dec. 30, 2000 (KR) ..... 2000-87353

(51) Int. Cl.[7] ..... B65H 1/00
(52) U.S. Cl. ..... 271/145; 271/162; 271/220
(58) Field of Search ..... 271/145, 162, 271/164, 171, 220; 221/312 R; 414/789, 789.1

(56) References Cited

U.S. PATENT DOCUMENTS

| | | | | | |
|---|---|---|---|---|---|
| 4,728,094 | A | * | 3/1988 | Yoshida | 330/286 |
| 4,849,786 | A | * | 7/1989 | Murakami | 271/3.03 |
| 5,327,206 | A | * | 7/1994 | Ueda et al. | 271/171 |
| 6,053,491 | A | * | 4/2000 | Cheong | 271/171 |
| 6,422,772 | B1 | * | 7/2002 | Fisher et al. | 271/145 |

* cited by examiner

*Primary Examiner*—Donald P. Walsh
*Assistant Examiner*—Joseph C Rodriguez
(74) *Attorney, Agent, or Firm*—Robert E. Bushnell, Esq.

(57) ABSTRACT

A paper cassette for an image forming device includes a cassette body having a receiving section for receiving paper and a guide lever movably disposed on a bottom of the cassette body for slant arranging sides of the received paper. The guide lever includes a guiding portion, a base member, and a hinge shaft for hingedly connecting the guiding portion and the base member. A stopping portion on the base member restricts hinged movement of the guiding portion.

30 Claims, 2 Drawing Sheets

PAPER CASSETTE FOR AN IMAGE FORMING DEVICE

CLAIM OF PRIORITY

This application makes reference to, incorporates the same herein, and claims all benefits accruing under 35 U.S.C. §119 from my application PAPER CASSETTE FOR IMAGE FORMING APPARATUS filed with the Korean Industrial Property Office on Dec. 30, 2000 and there duly assigned Serial No. 87353/2000.

BACKGROUND OF THE INVENTION

1. Technical Field

The present invention relates to a paper cassette for an image forming device, such as a copying machine or printer, which is a computer peripheral device. More particularly, the invention relates to an improved paper cassette enabling easy reception of paper in the paper cassette.

2. Related Art

Printers are widely used in offices and homes as computer peripheral devices. A printer prints documents or image data developed by an application program of the computer. Copying machines are also widely used in offices to copy documents. An image forming device, such as a printer or copying machine, includes at least one paper cassette. Accordingly, the image forming device is constructed to receive and store a print medium, such as paper, in the paper cassette.

Furthermore, various types of paper are used in the image forming device according to the needs of users. Each type of paper is received in a paper cassette which is designed to receive that type of paper.

A conventional paper cassette has at least one guide lever for properly arranging the paper according to its size. The paper received in the paper cassette is arranged and stacked by a front wall and a guide lever of the paper cassette. When the paper cassette is installed in the printer, a sheet of paper on top of the paper stack is contacted by a feeding device, such as a roller. Accordingly, in a print process, the sheets of paper are drawn into the image forming device, one by one, as the feeding device rotates.

When the paper runs out during the print process, paper should be additionally supplied. In the conventional paper cassette, the paper cassette is taken out of the image forming device, and paper of a certain size is supplied to a receiving section of the print cassette. Then, the print cassette is reinstalled in the image forming device.

When the paper is received in the paper cassette, the size of the paper does not match a space between the front wall and the guide lever of the paper cassette. Accordingly, before storing the paper in the receiving section, a user has to move the guide lever backward in order to provide space for the paper, store the paper, and then arrange the paper by advancing the guide lever. This results in a complicated paper loading and reception process.

SUMMARY OF THE INVENTION

The present invention has been developed in order to solve the above-mentioned problem. Accordingly, it is an object of the present invention to provide an improved paper cassette for an image forming device enabling easier receiving and arranging of paper in a cassette body.

To accomplish the above object, the paper cassette of the image forming device comprises a cassette body having a receiving section in which paper is received, and a guide lever disposed on a bottom of the cassette body for orienting a side of the received paper in a sloped manner by hinging in a certain direction.

The guide lever comprises a guiding portion moving between an arrange position for contacting and supporting a side of the paper received in the receiving section, and a release position separate from the arrange position. The guiding portion elastically returns from the release position to the arrange position. A base member is slidably disposed on the bottom of the receiving section for hingedly supporting the guiding portion, and a hinge shaft hingedly connects the guiding portion to the base member.

It is preferable that the base member have a stopping portion for restricting a hinging movement of the guiding portion.

It is also preferable that the guiding portion have a slope for slant orientation of the paper in a direction in which the paper is to be ejected.

Preferably, the guide lever further comprises an elastic member disposed between the base member and the guiding portion for elastically urging the guiding portion into the arrange position.

It is preferable that the elastic member be disposed around the hinge shaft.

It is also preferable that the elastic member be connected to the guiding portion, and to a wall extending from a base of the base member and at a right angle with respect to the bottom of the receiving section.

It is preferable that the receiving section have an inclined plane, and that the guide lever have a slope corresponding to that of the inclined plane for connecting and slant arranging the received paper in a direction in which the paper is to be ejected.

BRIEF DESCRIPTION OF THE DRAWINGS

A more complete appreciation of the invention, and many of the attendant advantages, thereof, will be readily apparent as the same becomes better understood by reference to the following detailed description when considered in conjunction with the accompanying drawings in which like reference symbols indicate the same or similar components, and wherein.

DETAILED DESCRIPTION OF THE PREFERRED EMBODIMENTS

Figure 1:
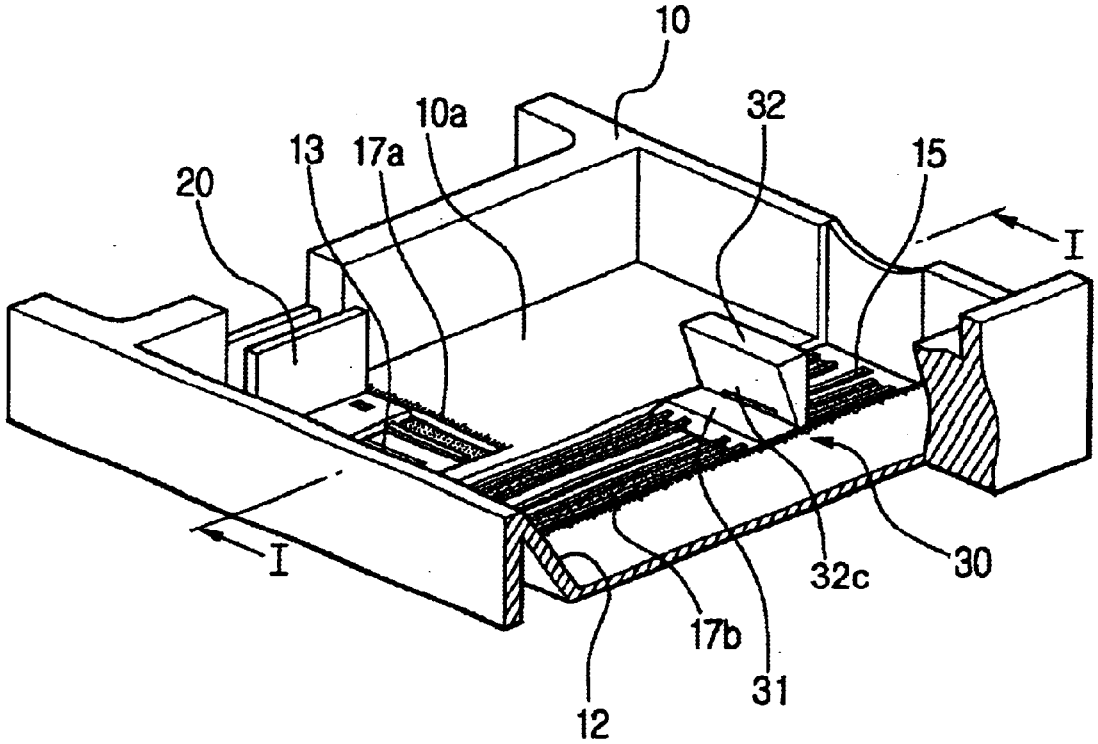
FIG. 1 is a partial perspective view of a paper cassette according to a first preferred embodiment of the present invention.

The present invention will now be described in more detail with respect to the various figures of the drawings, in which FIG. 1 is a partial perspective view of a paper cassette according to a first preferred embodiment of the present invention.

Referring to FIG. 1, a paper cassette for an image forming device according to a first preferred embodiment of the present invention includes a cassette body 10 having a receiving section 10*a*, a first guide lever 20, and a second guide lever 30. Paper is received and stacked in the receiving section 10*a*. First and second guide rails 13 and 15, respectively, are formed on the bottom of the cassette body 10. Scale rulers 17*a* and 17*b* are formed near the first and second guide rails 13 and 15, respectively, to indicate the size of the received paper. The scale rulers 17*a* and 17*b* have scales for distinguishing standard and non-standard paper. The cassette body 10 further includes an inclined plane 12 disposed in the receiving section 10*a* and having a predetermined slope. The inclined plane 12 faces the second guide lever 30 in order to support the paper received in the receiving section 10*a* by contacting sides of the paper.

Figure 2:
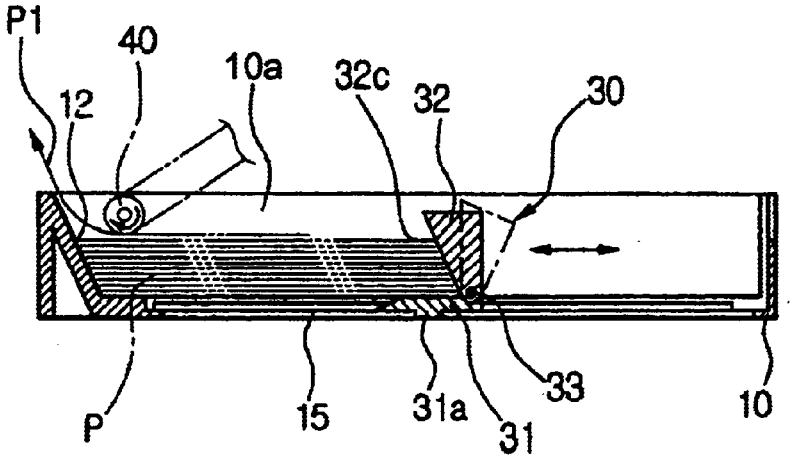
FIG. 2 is a cross sectional view taken along line I—I of FIG. 1.
Figure 3:
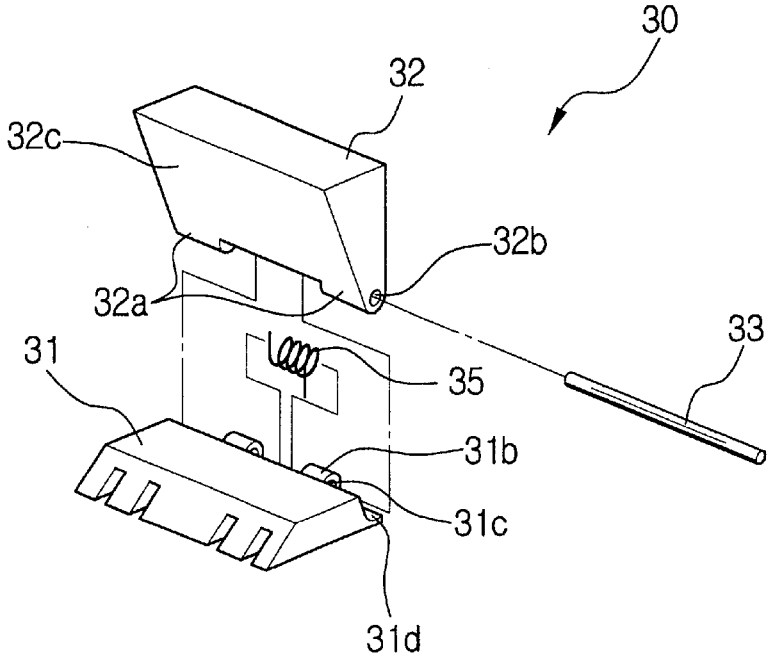
FIG. 3 is an exploded perspective view of a second guide lever of FIG. 1.

FIG. 2 is a cross sectional view taken along line I—I of FIG. 1, while FIG. 3 is an exploded perspective view of a second guide lever of FIG. 1. As shown in FIG. 2, the inclined plane 12 forms an obtuse angle with respect to the bottom of the receiving section 10*a* to enable easy ejection of the paper P.

The first and second guide levers 20 and 30, respectively, support and arrange the paper P in the receiving section 10*a* by contacting the paper P. The guide levers 20 and 30 slide along the guide rails 13 and 15, respectively, in a crosswise direction with respect to each other.

Referring to FIGS. 2 and 3, the second guide lever 30 includes a base member 31, a guiding portion 32, a hinge shaft 33, and an elastic member 35.

The base member 31 has a protrusion 31*a* corresponding to the second guide rail 15, and protruding from the lower surface of the base member 31. The protrusion 31*a* guides the base member 31 while moving along the second guide rail 15. It is preferable that the base member 31 be disposed on the same level as the receiving section 10*a*. A supporting part 31*b* is formed on a portion of the base member 31 which contacts the guiding portion 32 for hinging the hinge shaft 33. Holes 31*c* are formed in the supporting part 31*b* so that the hinge shaft 33 can be passed therethrough.

The guiding portion 32 is disposed on the base member 31, and hinges at a predetermined angle. The guiding portion 32 moves between an "arrange position" (shown by a solid line in FIG. 2) for contacting and supporting the sides of the paper P and a "release position" (shown by a broken line in FIG. 2) for departing from contact with the sides of the paper P. The guiding portion 32 includes a projection part 32*a*, corresponding to a supporting part 31*b*, and the hinge shaft 33. The supporting part 31*b* is disposed on the base member 31. Holes 32*b* are formed in the projection part 32*a*, so that the hinge shaft 33 is passed therethrough. When the hinge shaft 33 is passed through the holes 31*c* and 32*b*, the guiding portion 32 is hingedly supported on the base member 31 at a predetermined angle.

It is preferable that a stopping portion 31*d* be formed in the base member 31 to prevent the guiding portion 32 from overly hinging toward the paper P in the arrange position. The stopping portion 31*d* is formed by stepping a portion proximate to the supporting part 31*b*.

Also, the guiding portion 32 includes a slope 32*c* corresponding to the inclined plane 12 of the cassette body 10. The slope 32*c* has a slope similar to that of the inclined plane 12. Accordingly, the paper P between the slope 32*c* and the inclined plane 12 is slant arranged toward the inclined plane 12 (i.e., toward a paper ejecting direction).

It is preferable that the elastic member 35 be disposed on the hinge shaft 33. It is also preferable that the elastic member 35 be a torsion spring positioned between the base member 31 and the guiding portion 32. The elastic member 35 elastically presses the guiding portion 32 into the arrange position, i.e., in a direction in which the slope 32*c* contacts the paper P.

The operation of the paper cassette for the image forming device will be described below according to a first embodiment of the present invention.

First, when the paper cassette is empty, a user takes the cassette body 10 out of the image forming device. Then, the user takes paper P of a certain size with one hand, and hinges the guiding portion 32 with the other hand in a direction indicated by the broken line in FIG. 2. The paper P is first received between the guiding portion 32 and the inclined plane 12. Next, the user releases the guiding portion 32, and the guiding portion 32 returns to an initial position by pressure of the elastic member 35. When the guiding portion 32 returns to its initial position, the stopping portion 31*d* stops the guiding portion 32 by contacting the slope 32*c*, thereby restricting further hinging movement.

Accordingly, the received paper P is arranged with a certain slope corresponding to the slope 32*c* of the guiding portion 32 which pushes the paper P. That is, the sides of the paper P are arranged by contacting the inclined plane 12 and the slope 32*c*. Since the paper P is received in the receiving section 10*a* by a simple hinge action of the guiding portion 32, the entire guide lever 30 does not need to be moved, and thus the user is enabled to easily store the paper P in the cassette body 10.

After the paper P is stacked and arranged in the cassette body 10 as described above, the cassette body 10 is reinstalled in the image forming device. In this state, when a print command is inputted, a sheet of paper P1 on top of the paper stack is picked up by a pick-up 12 device, including components such as a pick-up roller 40. Then, the sheet of paper P1 is ejected from the cassette body 10 along the inclined plane 12. The ejected paper P1 is moved to a developing section (not shown) via a general paper feeding route (also not shown).

In the first preferred embodiment of the present invention, the print cassette includes the inclined plane 12 formed in the receiving section 10*a* and the slope 32*c* formed on the guide lever 30. However, the present invention can be applied to a print cassette without the inclined plane 12 or the slope 32*c*.

Figure 4:
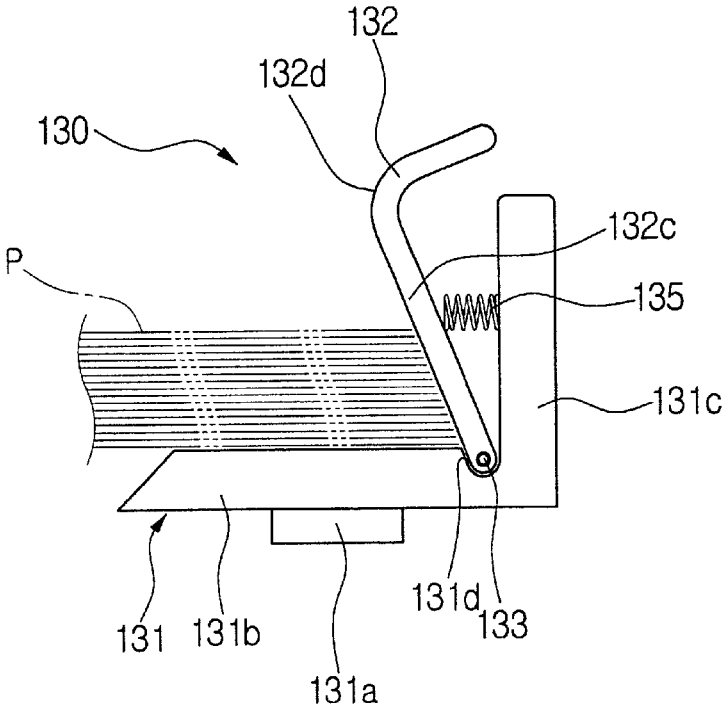
FIG. 4 is a side view of a second guide lever according to a second preferred embodiment of the present invention.

FIG. 4 is a side view of a second guide lever according to a second preferred embodiment of the present invention.

The guide lever 130 according to the second preferred embodiment includes a base member 131, a guiding portion 132, a hinge shaft 133, and an elastic member 135 as in the first preferred embodiment. The base member 131 includes a base 131*b* having a protrusion 131*a* extending from the lower surface of the base 131*b*, and a wall 131*c* extending vertically from the base 131*b*. A supporting part (not shown) is formed between the base 131*b* and the wall 131*c*, and has the same shape as the supporting part 31*b* shown in FIG. 3. The hinge shaft 133 is hingedly connected to the supporting part (not shown).

The guiding portion 132 is hinged on the base member 131 at a predetermined angle. That is, the guiding portion 132 moves between an "arrange position" in which it contacts and arranges the sides of the paper P, and a "release position" in which it does not contact the sides of the paper P.

In addition, a stopping portion 131*d* is step-formed in the base member 131 to prevent the guiding portion 132 from overly hinging toward the paper P.

The guiding portion 132 has a slope portion 132*c* corresponding to the inclined plane 12 of the cassette body 10. The slope portion 132*c* has a slope similar to that of the inclined plane 12 of the cassette body 10. Accordingly, as in the first preferred embodiment, the paper P is slant arranged toward the inclined plane 12 of the cassette body 10.

The guide portion 132 of the second preferred embodiment has a curved portion 132*d* which curves toward the wall 131*c* of the base member 131. The guiding portion 132 makes complete contact with the wall 131*c* in the release position.

In contrast to the first preferred embodiment, the elastic member 135 is disposed between the guiding portion 132 and the wall 131*c*. Accordingly, in the release position, the guiding portion 132 is pressed by the elastic member 135. That is, the elastic member 135 elastically presses the guiding portion 132 into the arrange position (i.e., into a contact direction of the slope 132*c* and the paper P). Elastic member 35 of the first preferred embodiment can be used in place of the elastic member 135 of the second preferred embodiment.

In the first preferred embodiment of the paper cassette of the present invention, as described above, the guide lever 30 having the guiding portion 32 hingedly disposed in the paper cassette ensures sufficient space for the paper reception without moving the guide lever 30. Accordingly, a user can easily store the paper P in the paper cassette. Also, since the paper P is arranged as the guiding portion 32 returns to its initial position, reception and arrangement of the paper P become easier.

In the drawings and specification, there have been disclosed typical preferred embodiments of the invention and, although specific terms are employed, they are used in a generic and descriptive sense only and not for purposes of limitation, the scope of the invention being set forth in, and limited only by, the appended claims.

What is claimed is:

1. A paper cassette for an image forming device, comprising:

a cassette body having a receiving section in which paper is received; and a guide lever disposed on a bottom of the cassette body for arranging sides of the received paper in a sloped manner by hinging in a certain direction;

wherein the receiving section includes a main surface having a first side on which said guide lever is disposed and a second side, opposite to the first side, on which an inclined plane is disposed, said guide lever having a slope corresponding to a slope of said inclined plane, said guide lever and said inclined plane cooperating to contact and slant arrange the received paper in a direction in which the paper is ejected; and wherein the guide lever comprises:

a guiding portion movable between an arrange position for contacting and supporting sides of the paper received in the receiving section, and a release position for departing from the arrange position, the guiding portion elastically returning from the release position to the arrange position;

a base member disposed on a bottom of the receiving section for hingedly supporting the guiding portion; and a hinge shaft for hingedly connecting the guiding portion to the base member.

2. The device as claimed in claim 1, wherein the base member has a stopping portion for restricting hinged movement of the guiding portion.

3. The device as claimed in claim 1, wherein the guiding portion has a slope portion for slant arranging the paper toward a direction in which the paper is ejected.

4. The device as claimed in claim 1, wherein the guide lever further comprises an elastic member for elastically urging the guiding portion into the arrange position.

5. The device as claimed in claim 4, wherein the elastic member is disposed around the hinge shaft between the base member and the guiding portion.

6. The device as claimed in claim 4, wherein the elastic member is connected to the guiding portion, and to a wall extending from the base member at substantially a right angle with respect to the bottom of the receiving section.

7. The device as claimed in claim 1, wherein the received paper is ejected from the second side.

8. A paper cassette device for an image forming device, comprising:

a cassette body having a receiving section in which paper is received; and a guide lever disposed on a bottom of the cassette body for arranging sides of the received paper in a sloped manner by hinging in a certain direction;

wherein the receiving section includes a main surface having a first side on which said guide lever is disposed and a second side, opposite to the first side, on which an inclined plane is disposed, said guide lever having a slope corresponding to a slope of said inclined plane, said guide lever and said inclined plane cooperating to contact and slant arrange the received paper in a direction in which the paper is ejected; and wherein the guide lever comprises:

a guiding portion movable between an arrange position for contacting and supporting sides of the paper received in the receiving section, and a release position for departing from the arrange position; and a hinge shaft for hingedly connecting the guiding portion to the bottom of the cassette body.

9. The device as claimed in claim 8, wherein said guide lever further comprises a stopping portion for restricting hinged movement of the guiding portion.

10. The device as claimed in claim 8, wherein the guiding portion has a slope portion for slant arranging the paper toward a direction in which the paper is ejected.

11. The device as claimed in claim 8, wherein the guide lever further comprises an elastic member for elastically pressing the guiding portion into the arrange position.

12. The device as claimed in claim 11, wherein the elastic member is disposed round the hinge shaft.

13. The device as claimed in claim 11, wherein the elastic member is connected to the guiding portion, and to a wall extending vertically at substantially a right angle with respect to the bottom of the receiving section.

14. The device as claimed in claim 8, wherein the receiving section has an inclined plane, and the guide lever has a slope, corresponding to a slope of the inclined plane, for connecting and slant arranging the received paper in a direction in which the paper is ejected.

15. The device as claimed in claim 14, wherein the guide lever is disposed on a first side of the received paper and the inclined plane is located on a second side, opposite to said first side, of said received paper.

16. The device as claimed in claim 15, wherein the received paper is ejected from the second side.

17. A paper cassette for an image forming device, comprising:

a cassette body having a receiving section in which paper is received; and a guide lever disposed on a bottom of the cassette body for arranging sides of the received paper in a sloped manner by hinging in a certain direction;

wherein the guide lever comprises a guiding portion movable between an arrange position for contacting and supporting sides of the paper received in the receiving section, and a release position for departing from the arrange position, the guiding portion elastically returning from the release position to the arrange position, said guide lever further comprising a base member slidably disposed on a bottom of the receiving section for hingedly supporting the guiding portion; and wherein the guiding portion has a slope portion for slant arranging the paper toward a direction in which the paper is ejected, and the receiving section has an inclined plane, the slope portion having a slope corresponding to a slope of the inclined plane.

18. The device as claimed in claim 17, wherein the guide lever comprises a hinge shaft for hingedly connecting the guiding portion to the base member.

19. The device as claimed in claim 17, wherein the base member has a stopping portion for restricting hinged movement of the guiding portion.

20. The device as claimed in claim 17, wherein the guide lever further comprises an elastic member for elastically urging the guiding portion into the arrange position.

21. The device as claimed in claim 20, wherein the elastic member is disposed around the hinge shaft between the base member and the guiding portion.

22. The device as claimed in claim 20, wherein the elastic member is connected to the guiding portion, and to a wall extending from the base member at substantially a right angle with respect to the bottom of the receiving section.

23. A paper cassette for an image forming device, comprising;

a cassette body having a receiving section in which paper is received; and a guide lever disposed on a bottom of the cassette body for arranging sides of the received paper in a sloped manner by hinging in a certain direction;

wherein the guide lever comprises a guiding portion movable between an arrange position for contacting and supporting sides of the paper received in the receiving section, and a release position for departing from the arrange position, the guiding portion elastically returning from the release position to the arrange position, said guide lever further comprising a base member slidably disposed on a bottom of the receiving section for hingedly supporting the guiding portion; and wherein the receiving section has an inclined plane, the guide lever is disposed on a first side of the received paper, and the inclined plane is located on a second side, opposite to said first side, of said received paper.

24. The device as claimed in claim 23, wherein the received paper is ejected from the second side.

25. A paper cassette for an image forming device, comprising:

a cassette body having a receiving section in which paper is received; and a guide lever disposed on a bottom of the cassette body for arranging sides of the received paper in a sloped manner by hinging in a certain direction;

wherein the guide lever comprises a guiding portion movable between an arrange position for contacting and supporting sides of the paper received in the receiving section, and a release position for departing from the arrange position, and a base member slidably disposed on a bottom of the receiving section for hingedly supporting the guiding portion;

wherein the guide lever further comprises an elastic member for elastically urging the guiding portion into the arrange position, the elastic member having one end connected to the guiding portion and another end connected to a wall extending from the base member at substantially a right angle with respect to the bottom of the receiving section; and wherein the receiving section has an inclined plane and the guide lever is disposed on a first side of the received paper and the inclined plane is located on a second side, opposite to said first side, of said received paper.

26. The device as claimed in claim 25, wherein the guide lever comprises a hinge shaft for hingedly connecting the guiding portion to the base member.

27. The device as claimed in claim 25, wherein the base member has a stopping portion for restricting hinged movement of the guiding portion.

28. The device as claimed in claim 25, wherein the guiding portion has a slope portion for slant arranging the paper toward a direction in which the paper is ejected.

29. The device as claimed in claim 25, wherein the guide lever has a slope corresponding to a slope of the inclined plane for contacting and slant arranging the received paper in a direction in which the paper is ejected.

30. The device as claimed in claim 25, wherein the received paper is ejected from the second side.

* * * * *